US006949151B2

(12) United States Patent
Müller et al.

(10) Patent No.: US 6,949,151 B2
(45) Date of Patent: Sep. 27, 2005

(54) METHOD FOR PRODUCING A HARDENED SHEET METAL SECTION

(75) Inventors: Oliver Müller, Paderborn (DE); Wilhelm Arns, Paderborn (DE); Peter Göer, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 574 days.

(21) Appl. No.: 10/166,019

(22) Filed: Jun. 10, 2002

(65) Prior Publication Data

US 2003/0000606 A1 Jan. 2, 2003

(30) Foreign Application Priority Data

Jun. 11, 2001 (DE) ..... 101 28 200

(51) Int. Cl.[7] ..... C21D 8/02

(52) U.S. Cl. ..... 148/648; 148/649; 72/342.1; 72/335

(58) Field of Search ..... 148/648, 579, 148/661, 649; 72/342.1, 335; 29/897.2

(56) References Cited

U.S. PATENT DOCUMENTS 6,293,134 B1 * 9/2001 Johnson ..... 72/335

FOREIGN PATENT DOCUMENTS

DE 24 52 486 A1 5/1975
WO WO 99/07492 2/1999

* cited by examiner

*Primary Examiner*—Deborah Yee
(74) *Attorney, Agent, or Firm*—Henry M. Feiereisen; Ursula B. Day

(57) ABSTRACT

The invention relates to a method for producing a hardened sheet metal section from a flat blank, wherein the flat blank is provided with collared holes that are collared and with two groove-like indentations which serve to support the sheet metal blank on a conveyor during heating treatment in an oven; subsequently, the blank is formed in a press tool into a sheet metal section by warm forming and where, if required, the formed indentations can be flattened; and thereafter the section is hardened while remaining clamped within the tool.

6 Claims, 1 Drawing Sheet

METHOD FOR PRODUCING A HARDENED SHEET METAL SECTION

CROSS-REFERENCES TO RELATED APPLICATIONS

This application claims the priority of German Patent Application Serial No. 101 28 200.1, filed Jun. 11, 2001, pursuant to 35 U.S.C. 119(a)–(d), the subject matter of which is incorporated herein by reference.

BACKGROUND OF THE INVENTION

The present invention relates, in general, to a method for producing hardened sheet metal sections and in particular for producing hardened sheet metal sections from a flat sheet metal blank or from a sheet metal blank that has been preformed.

Methods for hardening sheet metal sections from a blank are known in the prior art. For example, DE 24 52 486 A1 discloses a press hardening method, wherein a sheet metal blank from hardenable steel is heated to a hardening temperature and then hotformed and subsequently hardened while the sheet metal section remains within the press tool. As part of the hardening process, the sheet metal section remains clamped within the tool while it is being cooled during a cooling step, thereby ensuring a product of precise measurements and narrow tolerances.

Carrying out the steps of hotforming and hardening the sheet metal section while still in the press tool is advantageous since the combination of forming and hardening the section within the tool is generally very efficient with respect to time and cost.

Furthermore, WO 99/07492 discloses a modification of the afore-described press hardening method, wherein the rim area of the pre-made holes in the sheet metal sections are bent in such a manner that a collar is created. Collaring of the pre-made holes is carried out in the tool but prior to hardening. These holes in the sheet metal serve as lead through holes for screws or other fasteners.

Such collared holes can also be utilized to properly position sheet metal sections in the manufacturing operations described herein. In the respective terminology, such collared holes are also known as collared holes. They find application in particular in the motor vehicle industry, where collared holes are utilized in order to reinforce bores or passages present in car building parts, which are used in car manufacturing such as, for example, in transversal bars. Collared holes of this type are designed so that they can help prevent, for example, that a car building part will fail by pre-maturely buckling when the car is involved in car crash.

During production of flat or preformed sheet metal blanks, it can happen that the collars of the holes which extend from the horizontal plane of the blank get damaged when the blank is transported on a conveyor and the collars of the holes are supporting the blank. In addition, the collars can get caught in the conveyor, when the conveyor is, for example, composed of rollers. If the collars are becoming either deformed or caught while the blank is being transported, the production line is interrupted which leads to inefficient production.

One aspect of the present invention is to improve on the prior art and to provide an efficient method for producing hardened sheet metal sections with collared holes in such a manner so as to obviate shortcomings in the production of prior art sheet metal sections.

SUMMARY OF THE INVENTION

According to one aspect of the present invention, a method is provided for producing a sheet metal section formed from a flat blank or from a pre-formed flat blank, comprising the steps of forming one or more collared holes in the flat part of the blank and providing at least one indentation forming a protrusion and wherein the indentation results in a protrusion of rib-like configuration which extends in the same direction as the collar relative to the horizontal plane of the blank, transporting the blank on a conveyor to a heat treatment station where it is being heated and thereafter hotformed in a tool and then hardened. The collaring of the holes in the blank can be carried out either on pre-formed holes in the blank or can be carried out in one step from a blank with no pre-formed holes, for example in a stamping step. The indentation forming the protrusion can be stamped simultaneously when carrying out the collaring or they can be carried out separately after forming the collars. The collared holes can serve as reference points for the positioning of the sheet metal section in manufacturing operations herein described, or they can be used for reinforcing the sheet metal section, respectively as positioning references for mounting parts.

Preferably, the sheet metal or the semi-finished piece are made from steel having the following composition expressed in weight percentage: Carbon (C) 0.19 to 0.25; Silicon (Si) 0.15 to 0.50, Manganese (Mn) 1.10 to 1.40; Titanium (Ti) 0.020 to 0.050; Boron (B) 0.002 to 0.005; Aluminum (Al) 0.02 to 0.06 and Phosphorus (P) in an amount to maximal 0.025, Sulfur (S) maximal 0.015; Chromium (Cr) maximal 0.35 and Molybdenum (Mo) max. 0.35 and wherein to remainder is iron (Fe) inclusive of impurities that are melt-related.

The sheet metal blank which has been provided with collared holes and indentations forming one or more protrusions is brought to a hardening temperature in a heat treatment station where it is heated to a temperature above $Ac_3$ so that the steel is in an austenitic condition. This condition is generally reached at temperatures between 775° C. and 1000° C. Thereafter, the blank is subjected to the forming step inside the press tool, followed by a cooling step in order to harden the work piece. This treatment leads to a fine-grained martenisitic or bainitic material texture. During hardening, the sheet metal section remains clamped within the tool. Cooling of the metal section can be carried out directly or indirectly. When applying direct cooling, the sheet metal section is brought in direct contact with the cooling means. When applying indirect cooling, the press tool or parts of the press tool are being cooled.

According to one feature of the invention, the rib-like protrusion resulting from the indentations formed in at least the flat part of the sheet metal blank projects out further from the horizontal plane of the blank than the collar extends from the collared holes. This configuration ensures that the sheet metal blank is supported by the protrusions from the indentations when the blank is placed on the conveyor, while the collars of the collared holes stay clear of contact with the conveyor. The protrusions can have a variety of configurations and those shown here as ribs extending parallel to the conveying direction are exemplary configurations shown for simplicity's sake.

In a particularly advantageous embodiment of the invention, the indentation is configured as a groove or has a groove-like configuration so that the resulting protrusion extends parallel to the conveying direction. This ensures a safe transport of the flat metal blanks through the heat treatment station. For example, with the afore-described means, the flat sheet metal blank is prevented from getting caught in the conveyor, for example between the oven rollers. The protrusions from the groove-like indentations ensure a reliable supporting surface on the conveying means and may act as runners. In addition, the indentations serve as a means of overall reinforcement of the flat sheet metal blank, so that the flat blank is subjected to only slight bending in the heat treatment station while being transported on the conveyor or during heating.

When the work piece is placed in the press tool, the indentations, if required, can also be flattened again which is advantageously carried out prior to the cooling step.

By means of providing the indentations according to the invention in the flat blanks, the stacking capacity of the blanks is preserved. Sliding or slipping of the stack of blanks is reduced or reliably eliminated. In addition, the protrusions of the indentations serve as supporting means to prevent that the collared holes and especially the collars are being damaged during the heat treatment and while the blank is being transported on the conveyor or, that the blank is getting caught in the conveyor. Also, the indentations serve as reinforcements, so that sheet metal blank is subject to only slight bending while being transported in the heat treatment station.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
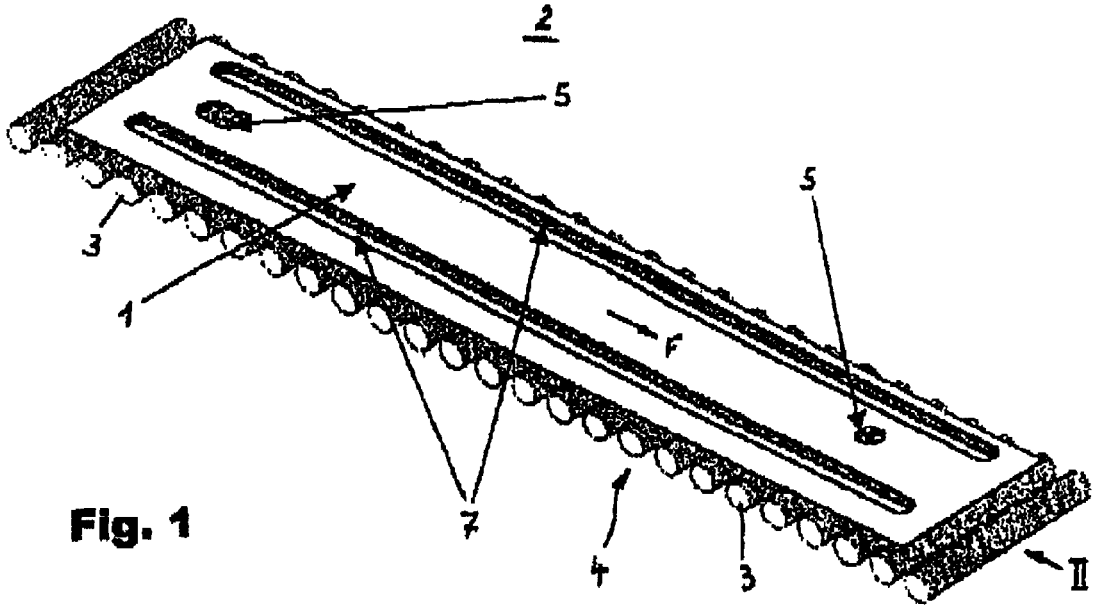
FIG. 1 is a perspective view of a flat blank according to the present invention placed on a conveyor.

Throughout all the Figures, same or corresponding elements are generally indicated by same reference numerals.

Figure 2:
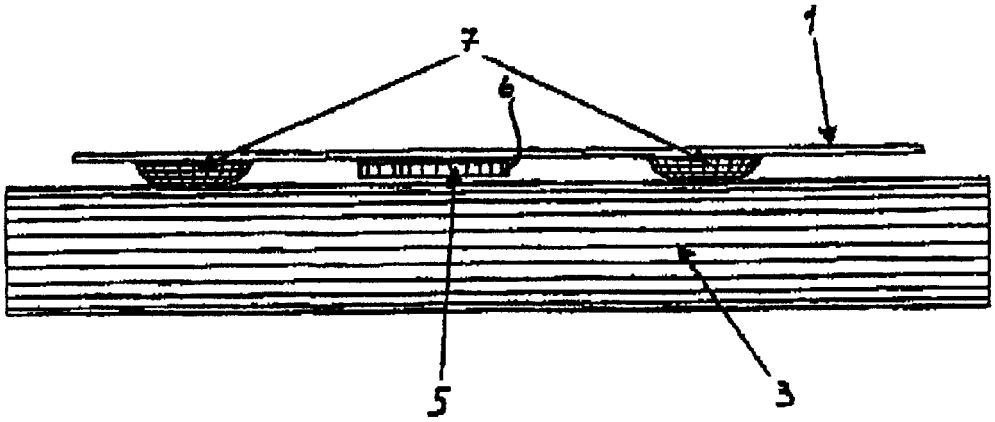
FIG. 2 is a front view of the flat blank of FIG. 1 along arrow II.

Turning now to the drawing, there is shown in FIG. 1 and FIG. 2, a flat blank 1 while passing through an oven 2 of a heat treatment station, not shown further in detail here. The flat blank 1 is seen supported by a conveyor 4, which is comprised of oven rollers 3.

Flat blank 1 is shown with collared holes 5 and each with a surrounding collar 6 which projects from the horizontal plane of the flat blank downwardly relative to the observing plane. The collared holes 5 were made during pre-cutting the flat blank which is also when the two groove-like indentations 7 are formed with the resultant protrusions that extend along the entire length of the flat blank 1. The indentations 7 forming the protrusions extend parallel to the length of the rectangular flat blank 1 and are oriented in the conveying direction (arrow F)—also, perpendicular to the longitudinal axis of the oven rollers 3. FIG. 2 illustrates that the protrusions extending from the indentations 7 have a depth dimension that is greater than the depth dimension of the collar portion 6 projecting from the horizontal plane of the flat blank and surrounding the collared holes 5. The collared holes are so configured that the collars surrounding the collared holes clear the oven rollers 3. The flat blank 1, which is supported on the oven rollers 3 by the protrusions from the indentations 7 is transported through the oven 2. Damage to the collared holes 5 or to the blank 1 getting caught in the conveyor during the transport is thus effectively prevented. In addition, the protrusions of indentations 7 serve as reinforcement of the flat blank 1 for ease of handling also during intermediary production steps. Due to the protrusions of indentations 7 acting as a reinforcement means of the blank 1, only a slight bending during transport of the blank through the oven can occur.

The flat blank 1 is heated in the oven to a temperature of about 970° C. and thereafter the sheet metal section is formed in a press tool under heat and subsequently hardened. Hardening of the sheet metal section is carried out while the sheet metal section is still clamped within the press tool.

While the invention has been illustrated and described as embodied in a sheet metal blank, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents.

What is claimed is:

1. A method for producing a hardened sheet metal product, comprising the steps of:

providing a sheet metal blank from sheet steel;

forming in the blank a plurality of collared holes;

indenting the blank to form at least one protrusion projecting outward in a same direction as the collars of the holes;

heating the blank on a conveyor in a heat treatment station;

hot forming the blank in a pressing tool to produce a sheet metal product; and hardening the sheet metal product.

2. The method of claim 1, wherein the protrusion is configured as a rib.

3. The method of claim 1, wherein the blank is preformed.

4. The method of claim 2, wherein the rib has a depth which is greater than a depth of the collar of the holes.

5. The method of claim 2, wherein the rib is configured in a groove-like shape and extending in parallel relationship to a conveying direction of the conveyor.

6. The method of claim 1, wherein the rib is flattened in the pressing tool.

* * * * *